US010064470B2

(12) United States Patent
Warne

(10) Patent No.: US 10,064,470 B2
(45) Date of Patent: Sep. 4, 2018

(54) MOTOR AND A HAIR CARE APPLIANCE COMPRISING A MOTOR

(71) Applicant: Dyson Technology Limited, Wiltshire (GB)

(72) Inventor: David George Warne, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 15/376,341

(22) Filed: Dec. 12, 2016

(65) Prior Publication Data

US 2017/0164710 A1 Jun. 15, 2017

(30) Foreign Application Priority Data

Dec. 11, 2015 (GB) ..... 1521889.4

(51) Int. Cl.
*A45D 20/12* (2006.01)
*A45D 20/50* (2006.01)

(52) U.S. Cl.
CPC ..... *A45D 20/12* (2013.01); *A45D 20/50* (2013.01)

(58) Field of Classification Search
CPC ..... A45D 20/12; A45D 20/50
USPC ..... 34/96, 97, 98, 99, 100; 392/384; 415/87
See application file for complete search history.

(56) References Cited

U.S. PATENT DOCUMENTS 2,268,929 A * 1/1942 Dupont ..... F01D 1/06 415/87
2,512,425 A * 6/1950 Hallinan ..... F24F 7/007 236/10
5,785,495 A 7/1998 Springer et al.
5,875,562 A * 3/1999 Fogarty ..... A45D 20/10 34/97
6,375,416 B1 4/2002 Farrell et al.
6,874,990 B2 * 4/2005 Nadeau ..... F04D 29/164 123/41.49
7,481,615 B2 * 1/2009 Park ..... F04D 29/164 123/41.49

(Continued)

FOREIGN PATENT DOCUMENTS

CH 146935 8/1931
CN 2904745 5/2007

(Continued)

OTHER PUBLICATIONS

International Search Report and Written Opinion dated Feb. 22, 2017, directed to International Application No. PCT/GB2016/053700; 10 pages.

(Continued)

*Primary Examiner* — Stephen M Gravini
(74) *Attorney, Agent, or Firm* — Morrison & Foerster LLP

(57) ABSTRACT

A hair care appliance including a motor for generating an airflow through the appliance, the motor comprising: a frame for supporting a rotor assembly, the frame including an outer wall; and a rotor assembly including a shaft and an impeller, the impeller including a plurality of blades. An impeller housing portion of the outer wall surrounds the impeller. An inner surface of the impeller housing portion includes at least one groove extending in an axial direction and positioned such that the at least one groove extends along at least the axial extent of the blades of the impeller.

15 Claims, 6 Drawing Sheets

(56) References Cited

U.S. PATENT DOCUMENTS

| | | | | |
|---|---|---|---|---|
| 8,469,658 | B2 * | 6/2013 | Gammack | F24F 7/065 415/182.1 |
| 8,616,842 | B2 * | 12/2013 | Avedon | F04D 29/542 29/888.025 |
| 2002/0004002 | A1 | 1/2002 | Irie et al. | |
| 2002/0164245 | A1 | 11/2002 | Okamura et al. | |
| 2003/0031559 | A1 | 2/2003 | Irie et al. | |
| 2003/0161728 | A1 | 8/2003 | Cho et al. | |
| 2006/0051204 | A1 * | 3/2006 | Lyons | F04D 29/422 415/204 |
| 2006/0216147 | A1 | 9/2006 | Park | |
| 2008/0044273 | A1 * | 2/2008 | Khalid | F04D 29/164 415/57.4 |
| 2010/0226763 | A1 * | 9/2010 | Gammack | F04D 25/08 415/182.1 |
| 2011/0162225 | A1 * | 7/2011 | Obermann | A45D 20/12 34/97 |
| 2016/0040595 | A1 * | 2/2016 | Devine | F02C 7/042 415/2.1 |
| 2017/0164710 | A1 * | 6/2017 | Warne | A45D 20/12 |

FOREIGN PATENT DOCUMENTS

| | | | | |
|---|---|---|---|---|
| DE | 501 662 | | 7/1930 | |
| DE | 28 18 872 | | 11/1978 | |
| DE | 101 38 063 | | 2/2003 | |
| EP | 0 441 752 | | 8/1991 | |
| EP | 1 134 427 | | 9/2001 | |
| GB | 2 012 362 | | 7/1979 | |
| GB | 2 093 526 | | 9/1982 | |
| GB | 2545412 | A * | 6/2017 | A45D 20/12 |
| JP | 53-115912 | | 10/1978 | |
| JP | 54-95001 | | 7/1979 | |
| JP | 54-135290 | | 9/1979 | |
| JP | 58-113504 | | 7/1983 | |
| JP | 64-11390 | | 1/1989 | |
| JP | 7-35082 | | 2/1995 | |
| JP | 2001-221198 | | 8/2001 | |
| JP | 2001-263296 | | 9/2001 | |
| JP | 2007-231749 | | 9/2007 | |
| JP | 2008-215082 | | 9/2008 | |
| JP | 2009-108782 | | 5/2009 | |
| JP | 2009-174455 | | 8/2009 | |
| KR | 10-2006-0103365 | | 9/2006 | |
| KR | 101155809 | B1 * | 6/2012 | F04D 29/164 |
| WO | WO 2017098200 | A1 * | 6/2017 | A45D 20/12 |

OTHER PUBLICATIONS

Search Report dated Jun. 2, 2016, directed to GB Application No. 1521889.4; 1 page.

* cited by examiner

MOTOR AND A HAIR CARE APPLIANCE COMPRISING A MOTOR

REFERENCE TO RELATED APPLICATIONS

This application claims the priority of United Kingdom Application No. 1521889.4, filed Dec. 11, 2015, the entire contents of which are incorporated herein by reference.

FIELD OF THE INVENTION

The present invention relates to a hair care appliance comprising a motor.

BACKGROUND OF THE INVENTION

Hair care appliances which generate an airflow, for example hair dryers or hot styling brushes, need motors to generate the airflow through them. A number of considerations must be taken with respect to the overall appliance. For instance, the size and weight of the appliance must be kept down in order that a user is able to handle the appliance easily, and that the appliance does not cause discomfort to the user during use.

In hair care appliances it is often the motor that contributes the most towards the size and weight of the overall appliance, and therefore it is important to minimise the size and weight of the motor as much as possible. However, reducing the size of the motor has its own limitations. For example, reducing the size of the motor may reduce the maximum flow rate that it can achieve, and therefore that the appliance can generate. Furthermore, in general the smaller a motor is the more susceptible it becomes to the ingress of foreign objects such as dust and hair into the motor.

In hair care appliances, ingress of loose hair can be particularly problematic. If strands of hair become wrapped around or entangled with moving parts of the motor, this can have a detrimental effect on the performance of the motor and therefore the entire hair care appliance. In extreme circumstances, the ingress of foreign objects such as hair into the motor could lead to faults occurring or even failure of the motor entirely.

SUMMARY OF THE INVENTION

Aspects of this invention provide a hair care appliance comprising a motor for generating an airflow through the appliance, the motor comprising: a frame for supporting a rotor assembly, the frame comprising an outer wall; and a rotor assembly comprising a shaft and an impeller, the impeller comprising a plurality of blades. An impeller housing portion of the outer wall surrounds the impeller. An inner surface of the impeller housing portion comprises at least one groove extending in an axial direction and positioned such that the at least one groove extends along at least the axial extent of the blades of the impeller.

As a result the one or more grooves provide a channel through which foreign objects such as strands of hair are able to pass the impeller blades. Alternatively, part of the hair strand may enter the groove whilst the rest of the strand gets chopped off by an impeller blade as it passes. This process may repeat such that a long strand of hair becomes chopped up into small, more manageable pieces. Therefore foreign objects and hair strands are less susceptible to becoming entangled with the impeller and other rotating parts of the motor. The motor is therefore better able at handling the ingress of foreign objects, and a greater level of reliability for the motor and also the overall appliance is achieved.

The outer wall may be substantially cylindrical. The uniform shape will make the motor easy to fit into the hair care appliance, and also allows for a greater freedom of choice as to where in the appliance the motor can be positioned.

A tip clearance between a radially outer extent of the impeller blades and the inner surface of the impeller housing portion may be less than 0.15 mm. The tip clearance may be between 0.075 mm and 0.09 mm. Accordingly, pressure losses due to air passing around the impeller blades can be minimised.

The depth of the one or more grooves may be between 0.1 mm and 0.5 mm, and may be substantially 0.25 mm. Accordingly, the groove is sufficiently dimensioned to allow foreign objects that typically ingress into the motor to pass through without becoming entangled, but at the same time keeping any associated pressure losses to a minimum.

The inner surface may comprise a plurality of grooves, and the grooves may be equally spaced apart around the inner circumference of the impeller housing portion. The inner surface may comprise three grooves. As such the motor is better able to handle ingress of foreign objects through the motor.

The impeller housing portion may be at an upstream end of the frame. Accordingly, the impeller is the first part of the motor that foreign objects will encounter as they ingress into the motor. The impeller and grooves can act together to chop up larger foreign objects, such as strands of hair, into smaller pieces, which make them easier to pass through the remainder of the motor. Therefore by having the impeller housing portion at an upstream end of the frame, ingress of foreign objects can be handled more effectively, and the likelihood of the foreign object causing a decrease in performance, or damage to the motor, is reduced.

The at least one groove may extend from the upstream edge of the frame. This allows for an easy machining operation when the grooves are created in the frame, and can therefore reduce the cost of manufacturing the motor, and in turn the appliance.

The impeller housing portion may be adjacent a diffuser portion of the frame. As such the impeller is positioned adjacent the diffuser and acts to quickly remove any swirl and/or turbulence in the airflow that is generated by the impeller. This increases the efficiency and performance of the motor.

The diffuser portion of the frame may comprise a plurality of diffuser vanes. The frame may comprise a substantially cylindrical inner wall which is concentric to the outer wall and positioned radially within the outer wall, and the plurality of diffuser vanes may extend between the inner wall and the outer wall of the frame. As a result, the inner and outer walls define a diffuser channel through which the generated airflow passes, and no separate diffuser is required in addition to the frame. By reducing the number of motor components in this way, the cost of the motor can be reduced, and in turn the cost of the appliance will be reduced.

The hair care appliance may be one of a hair dryer and a hot-styling brush.

This invention also provides a motor for generating an airflow through a hair care appliance, the motor comprising: a frame for supporting a rotor assembly, the frame comprising an outer wall; and a rotor assembly comprising a shaft and an impeller, the impeller comprising a plurality of blades. An impeller housing portion of the outer wall surrounds the impeller. An inner surface of the impeller housing portion comprises at least one groove extending in an axial direction and positioned such that the at least one groove extends along at least the axial extent of the blades of the impeller.

BRIEF DESCRIPTION OF THE DRAWINGS

In order that the present invention may be more readily understood, embodiments of the invention will now be described, by way of example, with reference to the following accompanying drawings, in which.

DETAILED DESCRIPTION OF THE INVENTION

Figure 1:
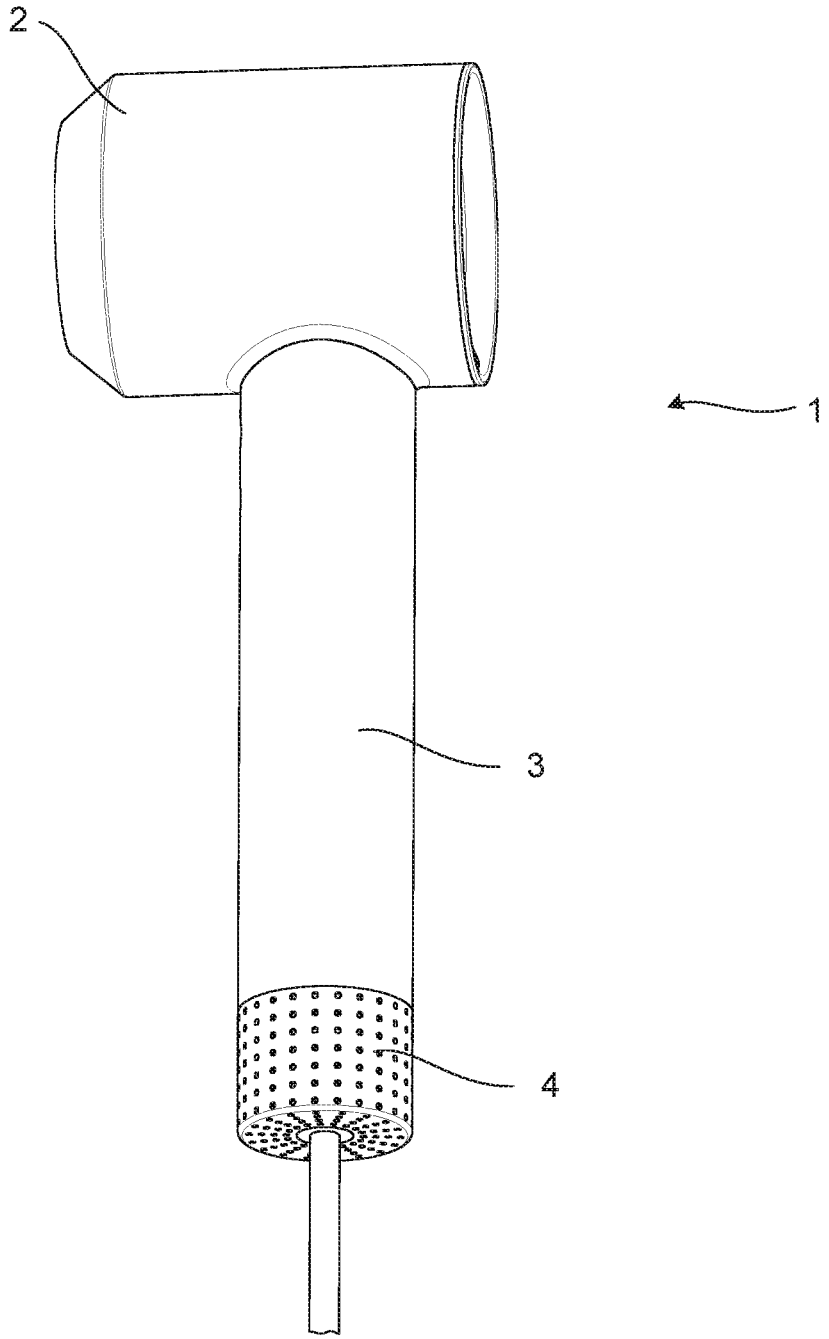
FIG. 1 is a hair care appliance.
Figure 2:
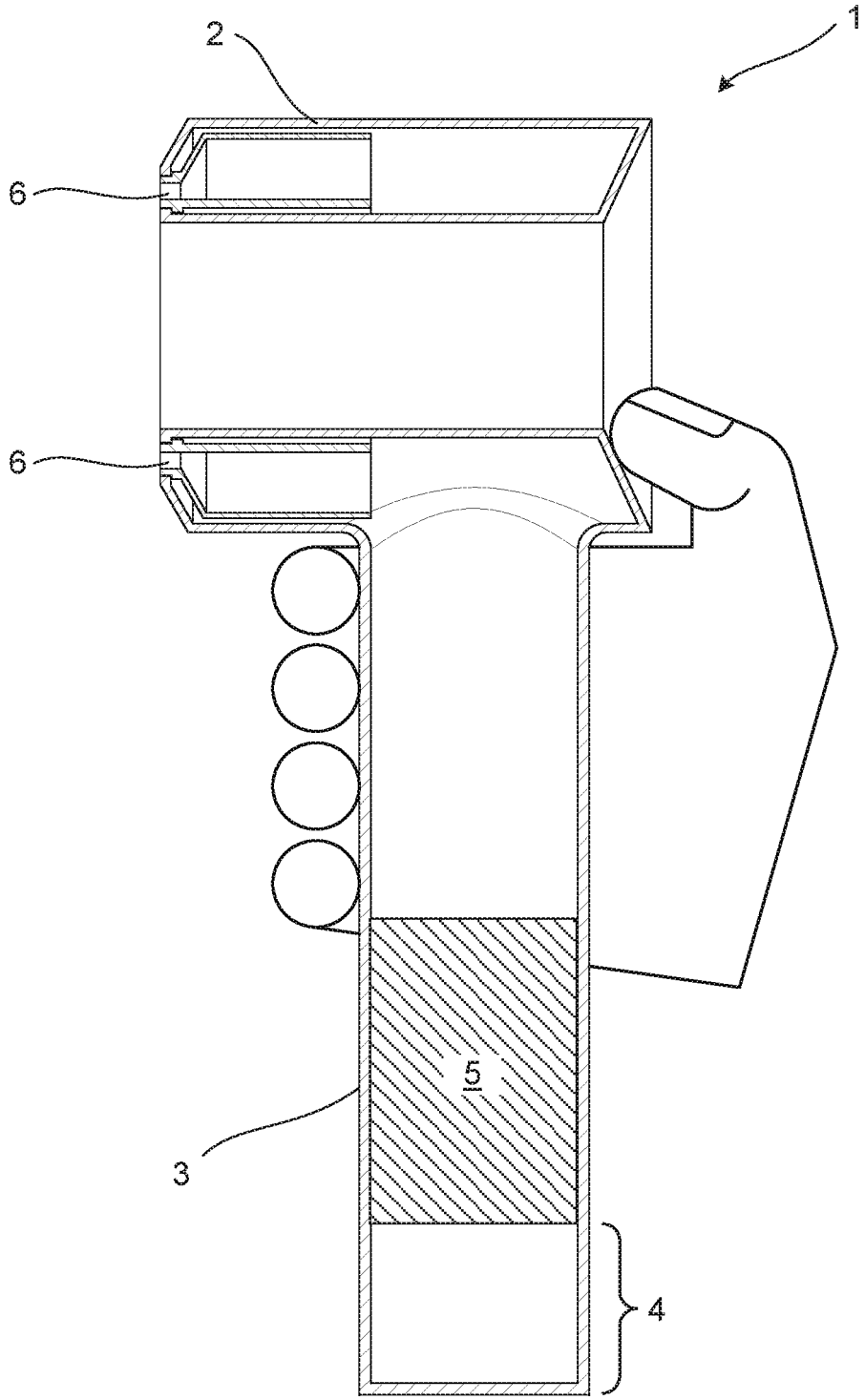
FIG. 2 is a cross section through the hair care appliance of FIG. 1.

FIGS. 1 and 2 show a hair care appliance, represented by hair dryer 1. FIG. 2 is a schematic illustration of a cross section through the hair dryer 1. The hair dryer 1 has a body 2 through which air is expelled, and a handle 3 attached to the body 2 by which a user can hold the hair dryer 1 as shown in FIG. 2. The handle 3 comprises an air intake 4 at an end of the handle 3 opposite the body 2. A motor 5 is located within the handle 3 such that it is positioned next to, or at least close to, the air intake 4. A filter or other filtering means (not shown) may be provided at the air intake 4, or between the air intake 4 and the motor 5, to prevent foreign objects which may be entrained in the airflow, such as hair or dust, from entering the motor 5.

During use, the motor 5 generates an airflow through the hair dryer 1. The motor 5 draws air into the handle 3 through the air intake 4. Air then passes through the motor 5 and from the handle 3 into the body 2 where is directed towards an air outlet 6. A heater (not shown), for example in the form of one or more heating elements, may be provided in the hair dryer 1 to heat the air prior to it being expelled from the air outlet 6.

A hair dryer 1 is shown as an example in FIGS. 1 and 2, however the motor 5 could be used in other hair care appliances that require the generation of an airflow. For example, the motor 5 could be included in a hot styling brush.

Figure 3:
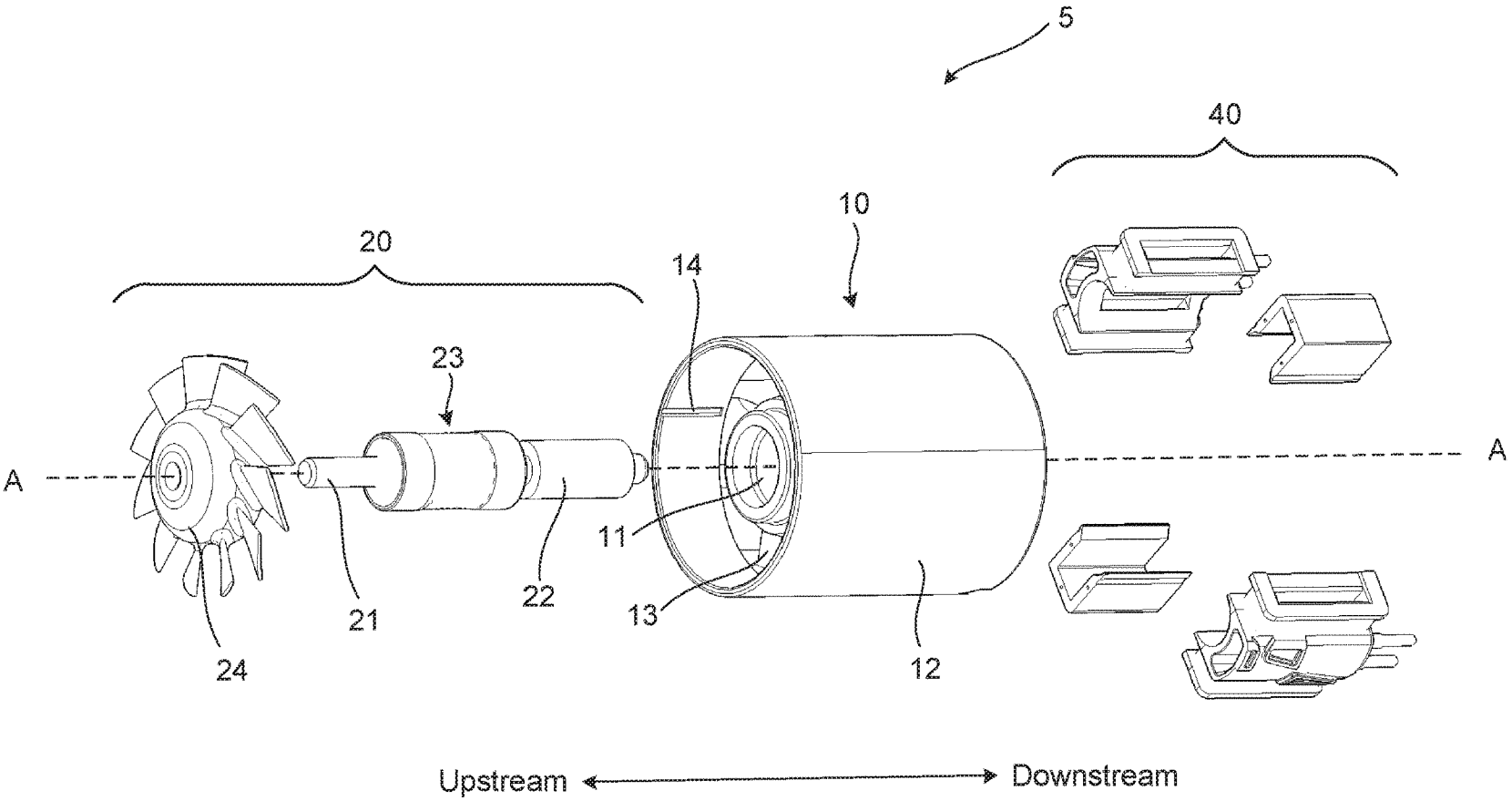
FIG. 3 is an exploded perspective view of a motor.

For the sake of clarity, the term "axial" is intended to mean in the direction of an axis running along a rotational axis of the motor 1 as depicted by axis A-A in FIG. 3. In addition, the directional terms "upstream" and "downstream" referred to herein refer to the direction of airflow through the motor when in use and are further clarified by the double headed arrow in FIG. 3.

Figure 4:
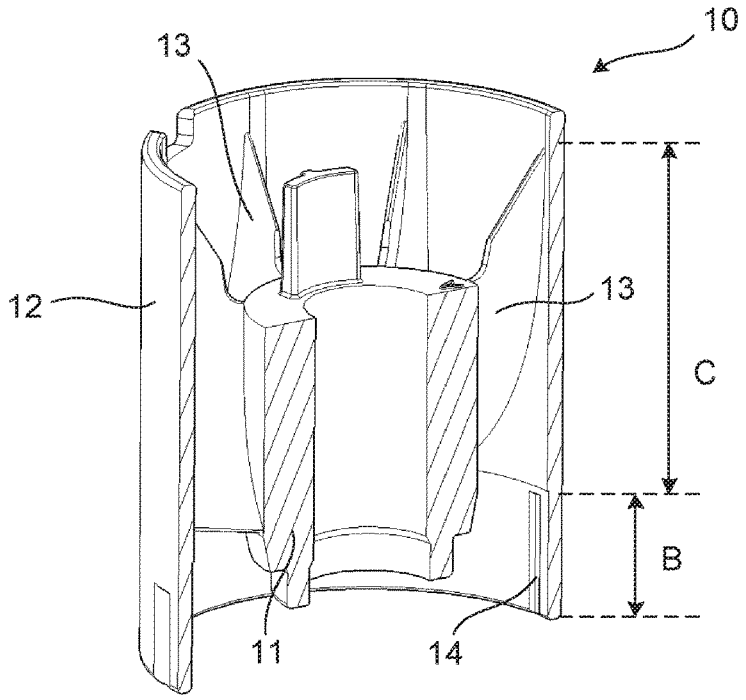
FIG. 4 shows a cross-section through a frame of the motor of FIG. 3.

FIG. 3 is an exploded perspective view of the motor 5. The motor 5 comprises a frame 10, a rotor assembly 20 and a stator assembly 40. A cross section through the frame 10 is shown in FIG. 4. The frame 10 comprises an inner wall 11 and an outer wall 12. A number of diffuser vanes 13 extend between the inner wall 11 and the outer wall 12. The frame 10 is formed of zinc and can be formed, for example, by machining or die-casting, or a combination of both machining and die-casting. A groove extending axially from the upstream end of the frame is formed on the inner surface of the outer wall 12.

An upstream end portion of the frame, indicated using the double arrow marked B in FIG. 4, houses the impeller when the motor is fully assembled. Accordingly, this area is referred to herein as the impeller housing portion of the frame 10. The impeller housing portion B comprises a groove 14 provided in the inner surface of the outer wall 12. The groove 14 extends from the upstream end of the frame 10 to substantially the end of the impeller housing portion B. Accordingly, when an impeller is in place in the frame 10, the groove 14 will extend past the axial extent of the blades of the impeller. Adjacent to the impeller housing portion B is a diffuser portion C of the frame 10 in which are provided the diffuser vanes 13 that extend between the inner wall 11 and outer wall 12 as described above.

Figure 5:
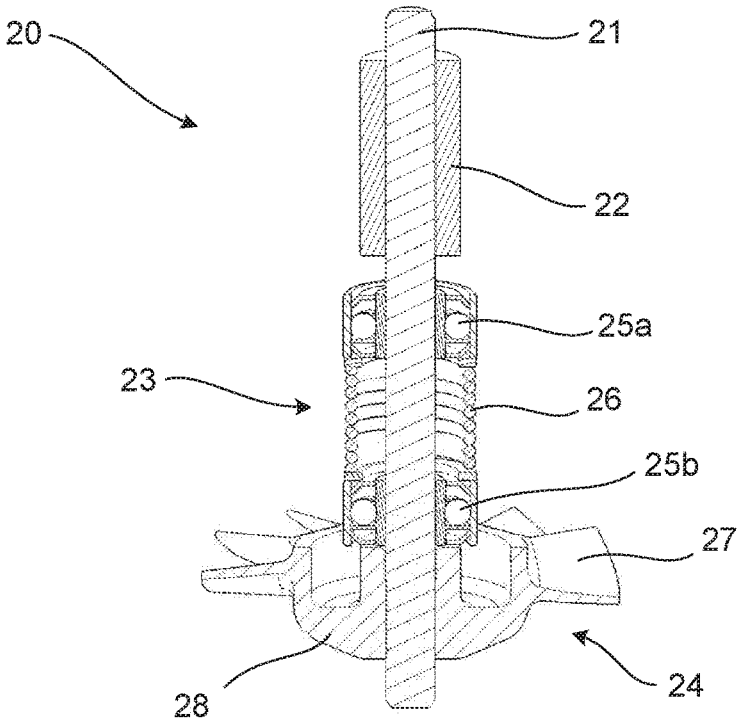
FIG. 5 shows a cross-section through a rotor assembly of the motor of FIG. 3.

The rotor assembly 20 comprises a shaft 21, a magnet 22, a bearing assembly 23 and an impeller 24. A cross-section through the rotor assembly 20 is shown in FIG. 5. The magnet 22, bearing assembly 23 and impeller 24 are all fixed directly to the shaft 21 by one or a combination of an interference fit and adhesive. The magnet 22 is a bonded permanent magnet of the sort typically used in permanent magnet brushless motors. In the example shown, the magnet 22 is a four-pole permanent magnet. The bearing assembly 23 comprises a pair of bearings 25*a*, 25*b* and a spring 26 separating the bearings 25*a*, 25*b*. The spring 26 acts to pre-load each of the outer races of the bearings 25*a*, 25*b* to reduce wear of the bearings during use. Once the rotor assembly 20 is assembled into the frame 10, the inner wall 11 of the frame 10 acts as a protective sleeve around the bearing assembly 23. The outer races of the bearings 25 are fixed to the inside circumference of the inner wall 11 by adhesive.

The impeller 24 shown in the Figures is an axial impeller with a plurality of blades 27 spaced circumferentially around, and extending radially out from, a central hub 28. During operation of the motor 5, as each blade 27 spins, it creates sound waves at a specific frequency. It is therefore possible to design the impeller in such a way as to reduce its acoustic impact. The impeller 24 shown in the Figures comprises eleven blades. However, the number of blades 27 can differ according to the acoustic requirements of the motor 5 and/or hair care appliance. For example, an impeller may comprise thirteen blades instead of eleven. In this alternative example, due to a higher number of smaller blades, the impeller would generate an acoustic tone that has a higher frequency than the impeller 24 of FIG. 3 that has only eleven blades 27. The motor 5 can therefore be configured such that, at typical operating speeds for the motor, the frequency of the tone generated by its impeller may be high enough so as to be outside the typical hearing range of a human. This reduces the acoustic impact of the motor 5 and therefore reduces the overall noise generated by the appliance, i.e. the hair dryer 1, during use.

The impeller 24 is formed by machining aluminium. Aluminium is a very light material and therefore by using it to form the impeller 24 this helps to counteract some of the additional weight included in the motor 5 by using zinc to create the frame 10. When used in a hair care appliance such as the hair dryer 1 of FIGS. 1 and 2, or another hair care appliance, the motor 5 will typically be run at rotational speeds of around 75 to 110 krpm. The magnitude of the forces acting on the impeller 24 at these high speeds are very great. Thankfully, despite being light, aluminium is also very strong and so the impeller 24 is capable of withstanding the large forces subjected to it when it rotates at high speed.

Figure 6:
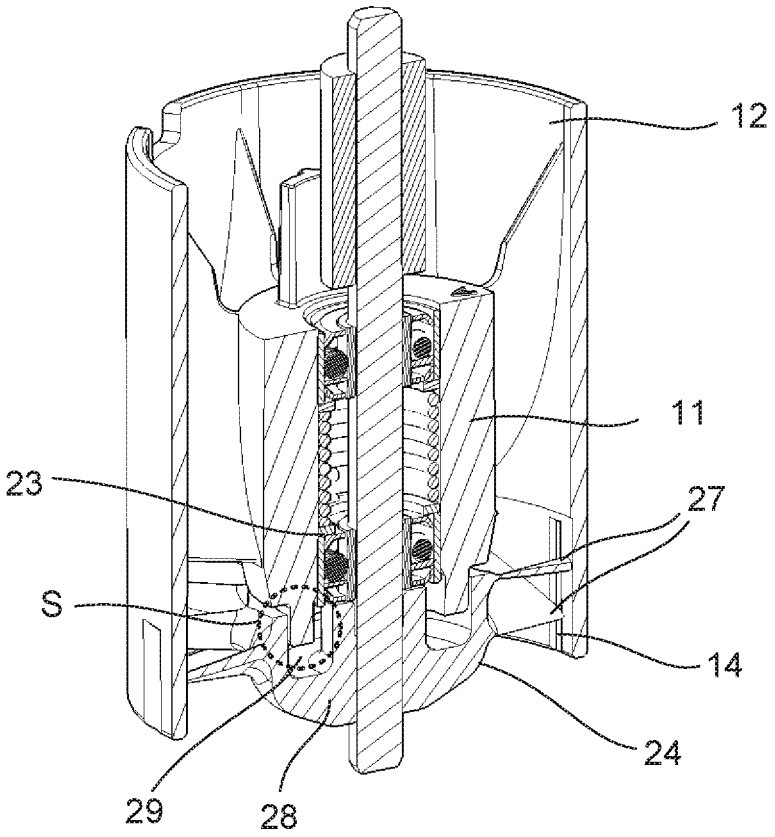
FIG. 6 shows a cross section through the frame and rotor assembly of a partly assembled motor such as that shown in FIG. 3.

FIG. 5 shows that the hub 28 of the impeller 24 comprises a recess 29 in the downstream side of the hub. By having a recess 29, this further decreases the weight of the impeller 24, which counteracts even more of the weight added using zinc to form the frame 10. In addition, the recess 29 is annular and provides a cavity into which an axially extending portion or protrusion of the inner wall of the frame can extend. This creates a labyrinth seal inside the hub 28 of the impeller 24 which prevents foreign objects, such as hair and dust, from entering into the bearing assembly 23 which could damage the rotor assembly and significantly reduce the lifetime of the motor. The labyrinth seal can be seen in FIG. 6 which shows a cross section through the assembled frame 10 and rotor assembly 20. The labyrinth seal is highlighted at area S. FIG. 6 also shows how the inner wall 11 of the frame 10 acts as a protective sleeve around the bearing assembly 23, as previously described.

As shown in FIG. 6, the groove 14 in the inner surface of the outer wall 12 extends from the upstream end of the frame 10 past the axial extent of the blades 27 of the impeller 24. The groove 14 provides a channel through which foreign objects such as strands of hair are able to pass. When strands of hair and other foreign objects or materials are entrained in the airflow entering the motor 5, they may contact the impeller 24. Foreign objects are then driven radially outwards due to centrifugal forces generated by the impeller 24. Foreign objects therefore collect at the tips of the blades 27 and are able to pass downstream of the impeller blade through the groove 14. Without the groove 14 there is a risk that foreign objects could become caught on the impeller blades and/or between the blades and the outer wall of the frame, thus reducing the performance of the motor or causing a failure.

Larger foreign objects, for example strands of hair may only partially enter the groove 14. As the impeller 24 spins, the strand of hair may be chopped up by the blades 27. Accordingly, the groove 14 acts to reduce the size of larger foreign objects and makes it easier for them to pass through the remainder of the motor.

Only one groove 14 is visible in FIG. 6. However, multiple grooves 14 may be provided to more effectively deal with the ingress of foreign objects into the motor 5. Of course, it will be understood that a balance must be struck between obtaining effective protection from the ingress of foreign objects whilst also reducing pressure losses around the impeller. A frame 10 comprising three grooves 14 has been found to be particularly advantageous in this regard. When more than one groove 14 is provided in the frame 10 it is preferable if the grooves are evenly spaced apart around the inner circumference of the outer wall 12.

Figure 7:
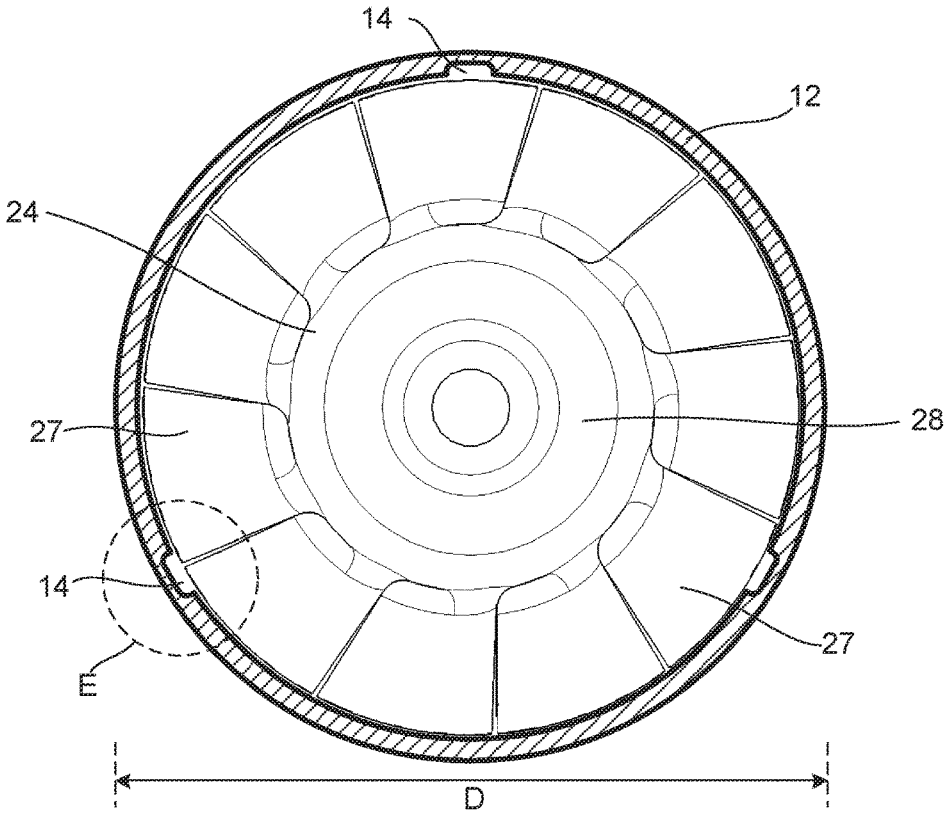
FIG. 7 shows an end view of the frame and impeller of the motor of FIG. 3.

FIG. 7 shows an end view of the frame 10 and impeller 24 of the motor 5 of FIG. 3. The outer wall 12 comprises three grooves 14 which are spaced even around the inner circumference of the outer wall 12. The impeller blades 27 extend radially out from the hub 28 of the impeller 24, and the radial extent of the blades (i.e. the tips of the impeller blades) come into very close proximity to the inner circumference of the outer wall 12 of the frame 10. The motor 5 shown in the figures, and which is incorporated into hair care appliances such as the hair dryer shown in FIGS. 1 and 2, has an outer diameter of between 20-35 mm. An outer diameter of substantially 27 mm has been found to be particularly beneficial. This small size allows the motor 5 to be located in the handle of the hair care appliance, as shown in FIG. 2. However, with a motor this small, in order to generate the required level of air flow through the appliance the impeller must rotate at very high speeds, for example between 75-110 krpm.

Figure 8:
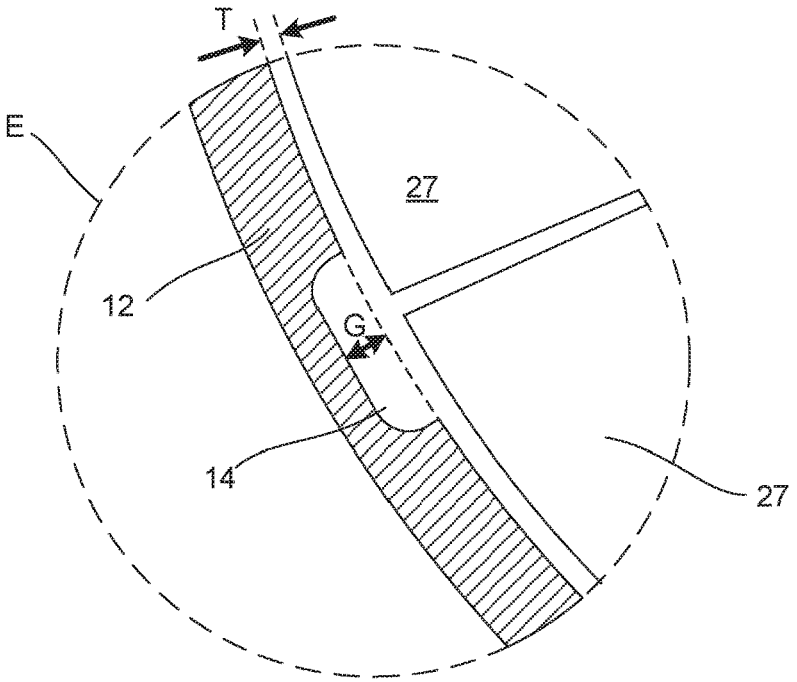
FIG. 8 is a magnified view of area E identified in FIG. 7.

An area E around one of the grooves 14 has been highlighted by a dotted line in FIG. 7, and a magnified view of area E is shown in FIG. 8.

The gap between the tips of the impeller blades 27 and the outer wall 12 is referred to as the tip clearance, and is identified in FIG. 8 as dimension T. The tip clearance T must allow for free movement of the impeller 24 within the frame 10, but whilst minimising pressure losses caused by air passing between the outer wall 12 and the impeller blades 27. A tip clearance of less than 0.15 mm, and particularly between 0.075 mm and 0.09 mm, has been found to deliver optimum performance for the motor 5 shown in the figures.

The grooves 14 have a depth G. A groove depth G of between 0.1 mm and 0.5 mm has been found to be particularly effective to balance reduction of pressure losses with protection against ingress of foreign objects. In particular a groove depth G of 0.25 mm has been found to be particularly beneficial. Accordingly, the groove is sufficiently dimensioned to allow foreign objects that typically ingress into the motor to pass through the motor without becoming entangled, but at the same time keeping any associated pressure losses at a minimum.

Whilst particular embodiments have thus far been described, it will be understood that various modifications may be made without departing from the scope of the invention as defined by the claims.

The invention claimed is:

1. A hair care appliance comprising a motor for generating an airflow through the appliance, the motor comprising:

a frame for supporting a rotor assembly, the frame comprising an outer wall; and a rotor assembly comprising a shaft and an impeller, the impeller comprising a plurality of blades;

wherein an impeller housing portion of the outer wall surrounds the impeller, and an inner surface of the impeller housing portion comprises at least one groove that extends in an axial direction and is positioned such that the at least one groove extends along at least an axial extent of the blades of the impeller such that at least some objects that collect at tips of the blades are able to pass downstream of the blades through the at least one groove.

2. The hair care appliance of claim 1, wherein the outer wall is cylindrical.

3. The hair care appliance of claim 1, wherein a tip clearance between a radially outer extent of the impeller blades and the inner surface of the impeller housing portion is less than 0.15 mm.

4. The hair care appliance of claim 3, wherein the tip clearance is between 0.075 mm and 0.09 mm.

5. The hair care appliance of claim 1, wherein a depth of the one or more grooves is between 0.1 mm and 0.5 mm.

6. The hair care appliance of claim 5, wherein the depth of the one or more grooves is substantially 0.25 mm.

7. The hair care appliance of claim 1, wherein the inner surface comprises a plurality of grooves, and the grooves are equally spaced apart around the inner circumference of the impeller housing portion.

8. The hair care appliance of claim 1, wherein the inner surface comprises three grooves.

9. The hair care appliance of claim 1, wherein the impeller housing portion is at an upstream end of the frame.

10. The hair care appliance of claim 1, wherein the at least one groove extends from an upstream edge of the frame.

11. The hair care appliance of claim 1, wherein the impeller housing portion is adjacent a diffuser portion of the frame.

12. The hair care appliance of claim 11, wherein the diffuser portion of the frame comprises a plurality of diffuser vanes.

13. The hair care appliance of claim 12, wherein the frame comprises a cylindrical inner wall which is concentric to the outer wall and positioned radially within the outer wall, and wherein the plurality of diffuser vanes extends between the inner wall and the outer wall of the frame.

14. The hair care appliance of claim 1, wherein the hair care appliance is one of a hair dryer and a hot-styling brush.

15. A motor for generating an airflow through a hair care appliance, the motor comprising:

a frame for supporting a rotor assembly, the frame comprising an outer wall; and a rotor assembly comprising a shaft and an impeller, the impeller comprising a plurality of blades;

wherein an impeller housing portion of the outer wall surrounds the impeller, and an inner surface of the impeller housing portion comprises at least one groove that extends in an axial direction and is positioned such that the at least one groove extends along at least an axial extent of the blades of the impeller such that at least some objects that collect at tips of the blades are able to pass downstream of the blades through the at least one groove.

* * * * *